US011834922B2

(12) United States Patent
Gallagher et al.

(10) Patent No.: US 11,834,922 B2
(45) Date of Patent: Dec. 5, 2023

(54) PISTON AND GATE ASSEMBLY FOR KINETIC PRESSURE CONTROL APPARATUS RAM

(71) Applicant: Kinetic Pressure Control, Ltd., Houston, TX (US)

(72) Inventors: Billy J. Gallagher, Houston, TX (US); Bobby J. Gallagher, Houston, TX (US); Steven A. Angstmann, Houston, TX (US); Robert Frith, Queensland (AU)

(73) Assignee: Kinetic Pressure Control Ltd., Houston, TX (US)

( * ) Notice: Subject to any disclaimer, the term of this patent is extended or adjusted under 35 U.S.C. 154(b) by 0 days.

(21) Appl. No.: 17/633,196

(22) PCT Filed: Aug. 14, 2020

(86) PCT No.: PCT/US2020/046332

§ 371 (c)(1),
(2) Date: Feb. 5, 2022

(87) PCT Pub. No.: WO2021/030673

PCT Pub. Date: Feb. 18, 2021

(65) Prior Publication Data

US 2022/0275697 A1 Sep. 1, 2022

Related U.S. Application Data

(60) Provisional application No. 62/887,119, filed on Aug. 15, 2019.

(51) Int. Cl.
*E21B 33/06* (2006.01)

(52) U.S. Cl.
CPC ..... *E21B 33/062* (2013.01)

(58) Field of Classification Search
CPC ..... E21B 33/062
USPC ..... 251/1.3, 301, 302
See application file for complete search history.

(56) References Cited

U.S. PATENT DOCUMENTS 1,404,350 A * 1/1922 Duckett ..... E21B 33/03 251/156
3,766,979 A * 10/1973 Petrick ..... E21B 29/08 166/63
3,771,601 A * 11/1973 Garrett ..... E21B 29/08 166/299

(Continued)

FOREIGN PATENT DOCUMENTS

WO WO-2018048612 A1 * 3/2018 ..... E21B 33/063

OTHER PUBLICATIONS

Written Opinion of the International Searching Authority and International Search Report, International Application No. PCT/US2020/046332, dated Oct. 28, 2020.

*Primary Examiner* — Daphne M Barry
(74) *Attorney, Agent, or Firm* — Victor H. Segura

(57) ABSTRACT

A ram for a blowout preventer has a pressure chamber having a piston movably disposed therein, and a charge disposed at one end of the pressure chamber. A gate is coupled to the piston on a side opposed to the charge. The gate is arranged to move across a through bore in a housing disposed at an opposed end of the pressure chamber. A coupling between the piston and the gate has sufficient strength to transfer kinetic energy of the gate to the piston.

12 Claims, 6 Drawing Sheets

(56) References Cited

U.S. PATENT DOCUMENTS

| | | | | |
|---|---|---|---|---|
| 3,991,649 | A * | 11/1976 | Patrichi | F42B 3/006 60/636 |
| 9,593,550 | B1 * | 3/2017 | Jennings | E21B 33/063 |
| 10,329,865 | B1 | 6/2019 | Baugh | |
| 2018/0010411 | A1 | 1/2018 | Cameron | |
| 2018/0252060 | A1 * | 9/2018 | Håverstad | E21B 33/062 |
| 2019/0203555 | A1 | 7/2019 | Gallagher et al. | |

* cited by examiner

PISTON AND GATE ASSEMBLY FOR KINETIC PRESSURE CONTROL APPARATUS RAM

CROSS REFERENCE TO RELATED APPLICATIONS

Continuation of International Application No. PCT/US2020/046332 filed on Aug. 14, 2020. Priority is claimed from U.S. Provisional Application No. 62/887,119 filed on Aug. 15, 2019. Both foregoing applications are incorporated herein by reference in their entirety.

BACKGROUND

This disclosure relates to the field of well pressure control apparatus such as blowout preventers ("BOPs"). More particularly the disclosure relates to pyrotechnically generated, gas pressure operated closure elements or valves (called "rams") used in BOPs. BOPs for oil and gas wells are used, among certain reasons, to prevent potentially catastrophic events known as blowouts, where high well fluid pressures and uncontrolled fluid flow from a subsurface formation into the well can expel tubing (e.g., drill pipe and well casing), tools and drilling fluid out of the well. Blowouts present a serious safety hazard to drilling crew, the drilling rig and the environment and can be extremely costly to remediate. Typically BOPs have rams that are opened and closed by actuators. The most common type of actuator is operated hydraulically to push one or more closure elements into and/or across a through bore in a BOP housing (itself sealingly coupled to the well) to close the well. In some cases the rams have hardened steel shears to cut through a drill string or other tools or devices which may be in the well and thus in the through bore at the time it is necessary to close the BOP.

A limitation of hydraulically actuated rams is that they require a large amount of hydraulic force to move the rams against the pressure inside the wellbore (and thus in the through bore) and in the case of shear rams subsequently to cut through objects in the through bore.

An additional limitation of hydraulically actuated rams is that the hydraulic pressure is typically generated at a location away from the BOP (necessitating a hydraulic line from the pressure source to the rams), making the BOP susceptible to failure to close if the hydraulic line conveying the hydraulic force is damaged. Other issues associated with hydraulically actuated rams may include erosion of cutting and sealing surfaces on the closure element(s) due to the relatively slow closing of the rams in a flowing wellbore. Cutting through tool joints, drill collars, large diameter tubulars and off center pipe strings under heavy compression may also present difficulties in the operation of hydraulically actuated rams.

Pyrotechnic gas pressure operated BOP rams have been proposed which address some of the limitations of hydraulically actuated BOPs. An example of such a pyrotechnic gas pressure operated BOP ram is described in International Application Publication No. WO 2016/176725 filed by Kinetic Pressure Control Limited. The pyrotechnic gas pressure is used to urge a piston to accelerate in a bore, and such acceleration is transferred to a gate or similar closure element whereby kinetic energy of the gate may be used to shear any devices disposed in a BOP housing through bore, thus closing the BOP. Such rams are referred to as "kinetic" BOP rams. In such kinetic BOP rams, the piston and gate are coupled directly together and move together as a single assembly between the initial, or open, position and the closed position. Because the kinetic BOP ram is pyrotechnically actuated, a large amount of axial force is transferred between the piston and the gate during actuation of the ram. Once the object within the BOP is sheared, the piston and the gate are stopped in the closed position. Because the primary stopping force in such kinetic BOP rams is imparted to the piston, the coupling between the piston and the gate also needs to be able to transfer that stopping force to the gate. Because the gate may have a large mass, the coupling between the piston and the gate may need to be capable of withstanding very large and abrupt forces in both axial directions.

SUMMARY

One aspect of the present disclosure relates to a kinetic ram for a blowout preventer. The kinetic ram has a pressure chamber having a piston movably disposed therein, and a charge disposed at one end of the pressure chamber. A gate is coupled to the piston on a side opposed to the charge. The gate is arranged to move across a through bore in a housing disposed at an opposed end of the pressure chamber. Coupling between the piston and the gate has sufficient strength to transfer kinetic energy of the gate to the piston to an energy absorbing element.

In some embodiments, an energy absorbing element is disposed in the chamber at an end opposed to the charge. The energy absorbing element is arranged to decelerate the piston upon contact with the energy absorbing element.

In some embodiments, the coupling comprises a tongue and groove coupling.

In some embodiments, a tongue is defined by a longitudinal end of the gate and a groove is defined by a slot in one face of the piston.

In some embodiments, the longitudinal end of the gate and the slot comprise mating splines.

Some embodiments further comprise an end plate disposed over each longitudinal end of the slot.

Some embodiments further comprise a locator dowel and a spring disposed in one face of the longitudinal end of the gate and a correspondingly located hole in the slot.

In some embodiments, the gate and the piston are formed as a single component.

In some embodiments, the gate and the piston are machined from a single component.

In some embodiments, the gate is welded to the piston.

In some embodiments, the gate comprises a constant thickness along a length of the gate.

In some embodiments, the gate comprises a smaller thickness at an end disposed in a slot in the piston than a thickness of a remainder of the gate.

In some embodiments, the gate comprises a section intermediate the piston and a longitudinal end of the gate opposed to the piston having a thickness greater than a thickness of the gate at the opposed longitudinal end.

In some embodiments, the gate is connected to the piston by a bolt.

In some embodiments, the piston comprises a negative space on a face opposed to the gate.

In some embodiments, the gate is locked to the piston by an insert shaped to fit in corresponding openings formed in the gate and in the piston.

A method for closing a through bore in a blowout preventer housing according to another aspect of the disclosure includes actuating a charge, applying gas pressure from the actuated charge to a movable piston, transferring force generated by the gas pressure applied to the piston to a gate to generate kinetic energy, moving the gate across the through bore and decelerating the piston proximate the through bore, and transferring deceleration of the piston to the gate.

In some embodiments, the transferring is performed by a coupling between the piston and the gate having sufficient strength to transfer all kinetic energy in the gate to the piston.

In some embodiments, the coupling comprises a tongue and groove coupling.

In some embodiments, a tongue is defined by a longitudinal end of the gate and a groove is defined by a slot in one face of the piston.

In some embodiments, the longitudinal end of the gate and the slot comprise mating splines.

Some embodiments further comprise an end plate disposed over each longitudinal end of the slot.

Some embodiments further comprise a locator dowel and a spring disposed in one face of the longitudinal end of the gate and a correspondingly located hole in the slot.

In some embodiments, the gate and the piston are formed as a single component.

In some embodiments, the gate and the piston are machined from a single component.

In some embodiments, the gate is welded to the piston.

In some embodiments, the gate comprises a constant thickness along a length of the gate.

In some embodiments, the gate comprises a smaller thickness at an end disposed in a slot in the piston than a thickness of a remainder of the gate.

In some embodiments, the gate comprises a section intermediate the piston and a longitudinal end of the gate opposed to the piston having a thickness greater than a thickness of the gate at the opposed longitudinal end.

In some embodiments, the gate is connected to the piston by a bolt.

In some embodiments, the piston comprises a negative space on a face opposed to the gate.

In some embodiments, the gate is locked to the piston by an insert shaped to fit in corresponding openings formed in the gate and in the piston.

Some embodiments comprise transferring kinetic energy from the piston to an energy absorbing element disposed in a path of the piston.

Some embodiments comprise transferring kinetic energy from the piston to an energy absorbing element disposed in a chamber at an end opposed to the charge. The energy absorbing element arranged to decelerate the piston upon contact with the energy absorbing element.

BRIEF DESCRIPTION OF THE DRAWINGS

FIG. 1 shows closing force (arrows) applied to the piston when in transit from open to closed position

FIG. 3 also shows end plates, mounting hardware for coupling the end plates to the gate and locator pins between the gate and the end plates.

DETAILED DESCRIPTION

Figure 1:
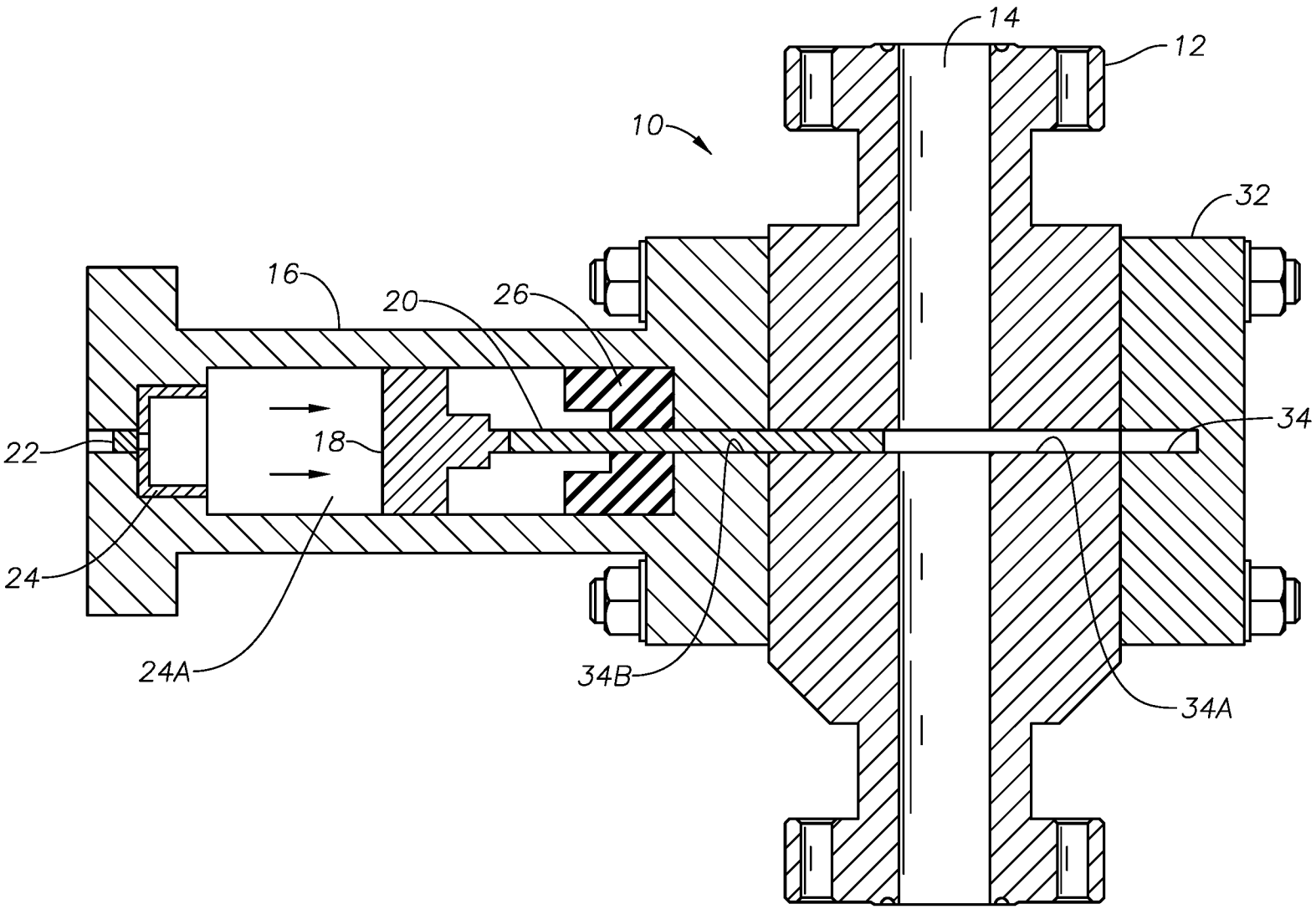
FIG. 1 shows a cross-sectional view of a pyrotechnic gas pressure operated ("kinetic") BOP which may include a piston and gate assembly according to the present disclosure disposed in a BOP housing.
Figure 2:
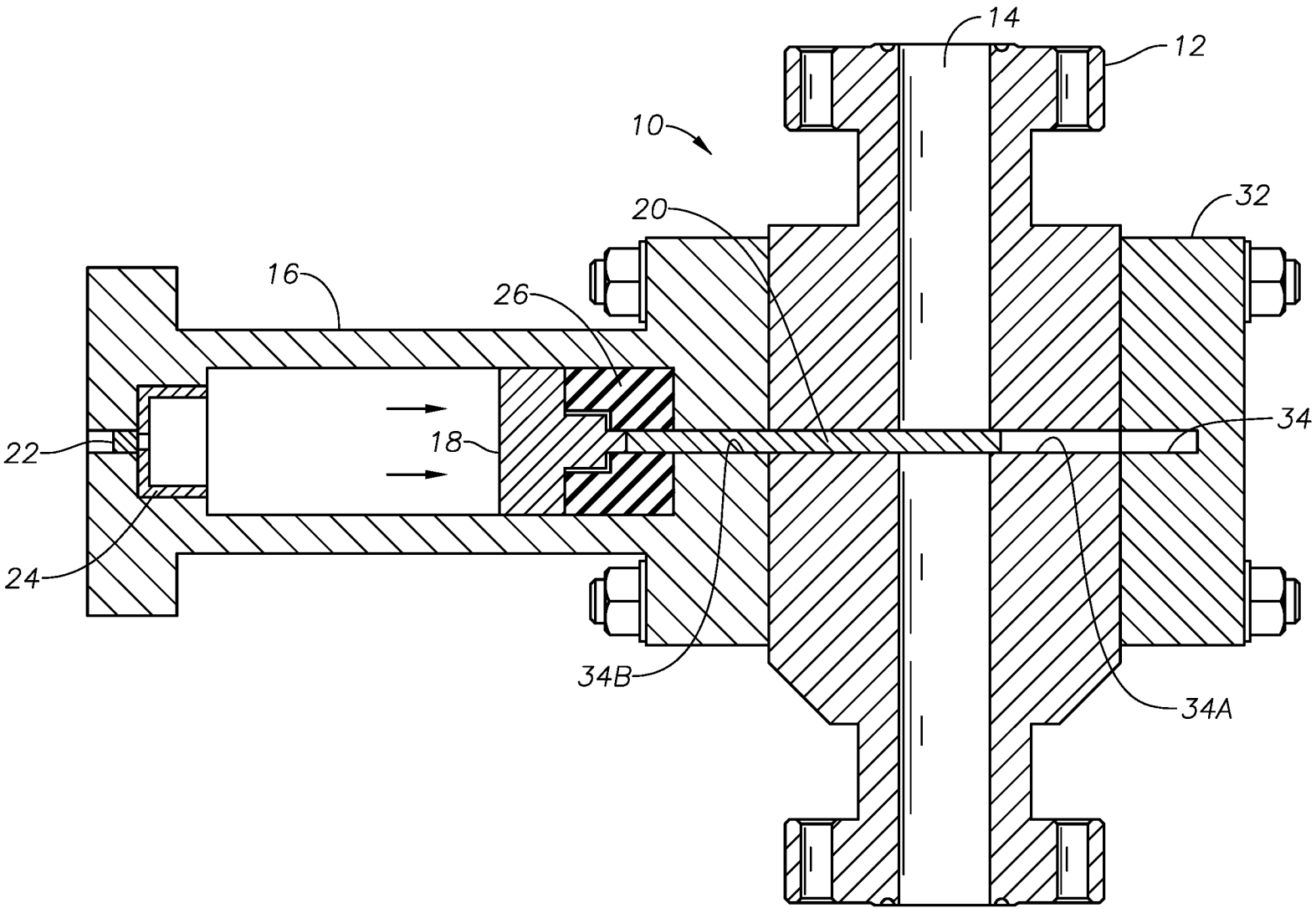
FIG. 2 shows the view of FIG. 1 wherein are depicted the gate approaching the closed position with stopping force imparted on the piston by an energy absorbing element.

In the following detailed description, like components common to the several drawings are identified with like reference numerals. FIG. 1 and FIG. 2 show, respectively, a side cross sectional view of a pyrotechnic gas operated BOP having a piston and gate according to the present disclosure. A non-limiting example of such a BOP is described in International Application Publication No. WO 2016/176725 filed by Kinetic Pressure Control Limited.

In FIG. 1, a pyrotechnic gas pressure operated BOP 10, which may also be referred to as a "kinetic BOP" comprises a housing 12 having a through bore 14. The housing 12 may be coupled to a wellhead, another BOP or a similar structure (not shown in the figures) so that such similar structure may be closed to flow by operating the kinetic BOP 10. A passageway 34 may be formed in a receiving cover 32 coupled to one side of the housing 12. The housing 12 may comprise a part 34A of the passageway adjacent to the passageway 34 in the receiving cover 32. A further part 34B of the passageway may be formed in a pressure chamber 16 coupled to an opposed side of the housing 12. The passageway 34 and its parts 34A, 34B provide a travel path for a gate 20. The travel path enables the gate 20 to attain sufficient velocity resulting from actuation of a pyrotechnic charge 24 and subsequent gas expansion against a piston 18 such that kinetic energy in the gate 20 may be sufficient to sever any device disposed in the through bore 14 and to enable the gate 20 to extend into the passageway 34 across the through bore 14. A seal (not shown) may provide effective flow closure between the through bore 14 and the gate 20 when the gate 20 is moved into the through bore 14 such that fluid pressure in the through bore 14 is excluded from the passageway 34 and parts 34A, 34B thereof. When the gate 20 is disposed across the through bore 14 after actuation of the pyrotechnic charge 24, the through bore 14 is thereby effectively closed to flow across the gate 20. The piston 18 may be decelerated by an energy absorbing element (brake) 26 such as a crush sleeve or similar device such that the piston 18 does not strike the housing 12 so as to damage the housing 12. The pyrotechnic charge 24 may be actuated by an initiator 22 of types well known in the art. The piston 18 and the gate 20 form an assembly to be described in more detail below. The particular embodiment of a piston and gate assembly shown in FIG. 1 will be explained in more detail with reference to FIG. 6.

Upon initial actuation of the pyrotechnic charge 24, there is a relatively small volume between the charge and the piston 18 before the piston 18 has begun to move. Such volume may be referred to as the "initial volume." There is also typically an amount of free volume inside the charge 24 itself because the propellant in the charge 24 is typically supplied as a granular substance. The relatively small initial volume is needed for proper function of the BOP 10 as such initial volume enables a high gas pressure to be generated rapidly on actuation of the charge 24, which provides a motive force to accelerate the piston 18 and consequently the gate 20. In addition, propellants used in such BOPs, such as a nitrocellulose- and/or nitroglycerin-based propellants, the rate of combustion of the propellant is related to the maximum gas pressure induced within a gas chamber 24A disposed between the charge 24 and the piston 18. Without the high pressure being generated, the piston 18 would not be accelerated to its required velocity. For purposes of defining the scope of the present disclosure it should be understood that a separate ram and piston are equivalent structures to an integral piston and ram, wherein such structures are functionally similar.

In FIG. 1, the charge 24 has been initiated so as to accelerate the piston 18 and the gate 20, wherein gas pressure operates in the direction shown by arrows in the chamber 16. FIG. 2 shows the piston 18 and gate 20 as the gate 20 crosses the through bore 14 to close the passage 34. In FIG. 2, the piston 18 contacts the energy absorbing element 16. Subsequent to the view in FIG. 2, the piston 18 will be decelerated by the energy absorbing element 26, and the gate 20, being coupled to the piston 18 to form an assembly, will also be decelerated as a result.

Figure 3:
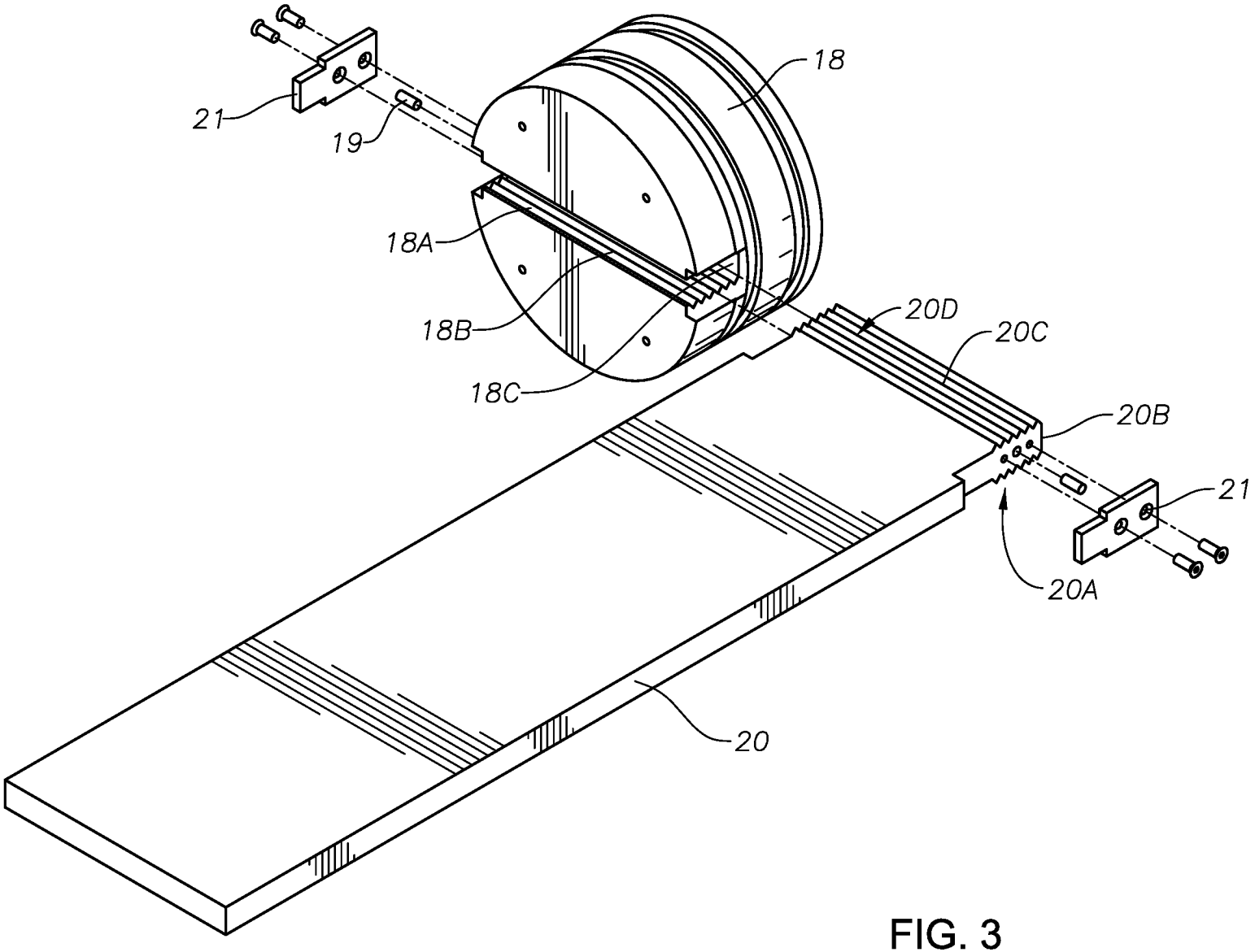
FIG. 3 shows an isometric exploded view of one example embodiment of the gate and the piston in the BOP of FIGS. 1 and 2.

FIG. 3 shows an example embodiment of a piston 18 and gate 20 that may be coupled by a tongue-in-groove connection to form an assembly. The tongue of the connection may be defined as the end of the body of the gate 20. The tongue may be defined by a tongue end face 20B and two tongue side walls 20C having locking features (e.g., splines) 20D thereon formed on the broad sides of the gate 20 proximate its longitudinal end.

The groove may be a slot 18A formed in one face of the piston 20 and shaped to receive the longitudinal end of the gate 20. The slot 18A may be generally rectangular in cross section to correspond to the cross section of the gate 20 and may be defined by a slot face 18C and two slot side walls 18B having mating locking features (e.g., splines). The slot 18A may be formed across the entire diameter of the piston 18. The slot 18A may be formed to correspond closely with the shape of the tongue.

The tongue side walls 20B may include one or more locking features 20D, e.g., grooves and/or protrusions formed therein such as the above mentioned splines. The splines 20D may have any suitable shape (square edges, rounded, saw tooth, etc.) and are shown in the accompanying figures as being generally trapezoidal in shape. The splines 20D may be formed such that they run along the tongue side walls 20C in a direction parallel to the groove 18A and perpendicular to the length of the gate 20.

The slot side walls 18B may also include splines that correspond with the one or more splines 20D on the tongue. When the gate 20 is installed to the piston 18, the splines 20D of the tongue side walls 20C mesh with the splines of the slot 18A such that the gate 20 is prevented from moving axially with respect to the piston 18. The splines 20D allow the stopping force to be transferred from the piston 18 to the gate 20 at the interfaces between the splines 20D of the tongue side walls 20C and the splines of the slot 18A.

The gate 20 may be installed to the piston 18 by sliding the gate 20 into the slot 18A from an end of the slot 18A such that the splines 20D are intermeshed. In some embodiments, the splines may be formed on the piston 18 and the corresponding grooves formed on the gate 20.

In some embodiments, the tongue end face 20B may be in contact with the slot face 18C when the gate 20 is installed to the piston 18. In such embodiments, at least part of the ram closing force may be transferred from the piston 18 to the gate 20 by the slot face 18C. Also, in such embodiments, the splines may be arranged such that the tongue is axially preloaded against the slot face 18C. An end plate 21 and locator pin 19 disposed on each lateral end of the slot 18A may be used to hold the gate 20 in the piston 18 laterally after assembly.

Figure 4:
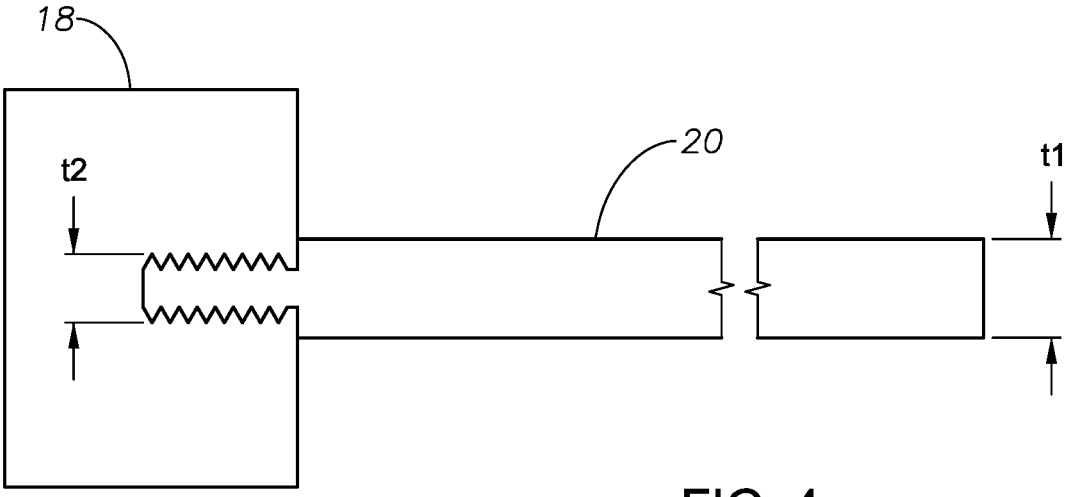
FIG. 4 shows a cross-section side view of another embodiment similar to the example embodiment shown in FIG. 3.

FIG. 3 shows an embodiment wherein the gate body has a uniform thickness along its length, with the splines 20D extending out from the surface of the gate 20. FIG. 4 shows a possible embodiment wherein the gate end with the protrusions (splines) has a reduced thickness t2 compared to the thickness t1 of the rest of the gate body.

In some embodiments, such as the one shown in FIG. 3, the gate may be held within the slot by end plates 21 as shown in FIG. 3. The end plates 21 may couple to the gate 20, to the piston 18, or to both. In the depicted embodiment, the end plates 21 couple directly to the tongue of the gate 20. The end plates 21 have a width larger than the width of the slot 18A and therefore abut the body of the piston 18 adjacent the slot 18A, preventing the gate 20 from sliding out of the slot 18A. The end plates 21 may have locator pins 19 that fit into locator holes on the gate 20 to assist with the installation of the end plates 21. The end plates 21 may be secured in place by screws or other fasteners. The piston 18 may include lands formed in the piston body that generally correspond with the shape of the end plates 21. For example, in some embodiments the lands may be flat so that the end plates may also be flat.

Figure 5:
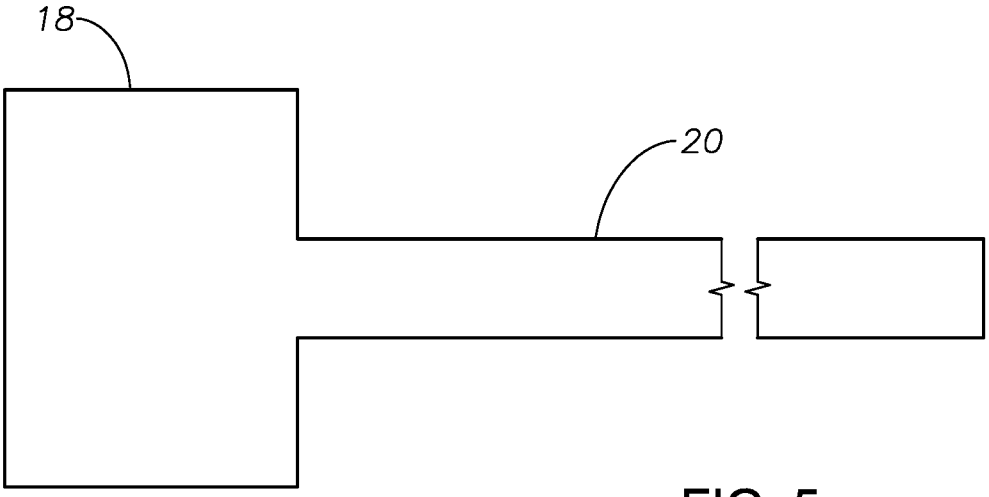
FIG. 5 shows a cross-section side view of a one-piece piston and gate embodiment.

FIG. 5 depicts a one-piece piston-gate unit. The piston 18 and gate 20 may be produced (e.g., via machining) as one piece. In other embodiments, the piston 18 and the gate 20 may be formed separately and subsequently connected permanently such as by welding.

Figure 6:
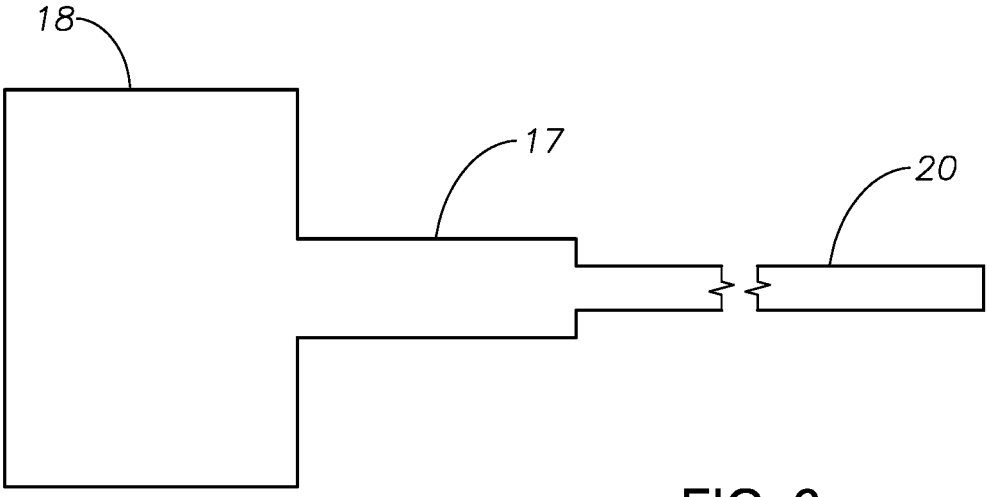
FIG. 6 shows a cross-section side view of another embodiment of a one-piece piston and gate.

FIG. 6 depicts a one-piece piston-gate with a thicker gate section 17 near the piston 18 (e.g., extending ¼ of the gate length). This thicker section 17 may increase structural strength of the gate 20 to resist gate buckling during transition of the ram from the open to closed position. Note that the thicker section 17 may strike the energy absorbing element (26 in FIG. 1) before the piston 18 does. Depending on the length of the thicker section 17 and on the configuration of the energy absorbing element (26 in FIG. 1) along the gate 20, the piston 18 face may or may not contact the energy absorbing element (26 in FIG. 1) when the gate 20 reaches the closed position.

Figure 7:
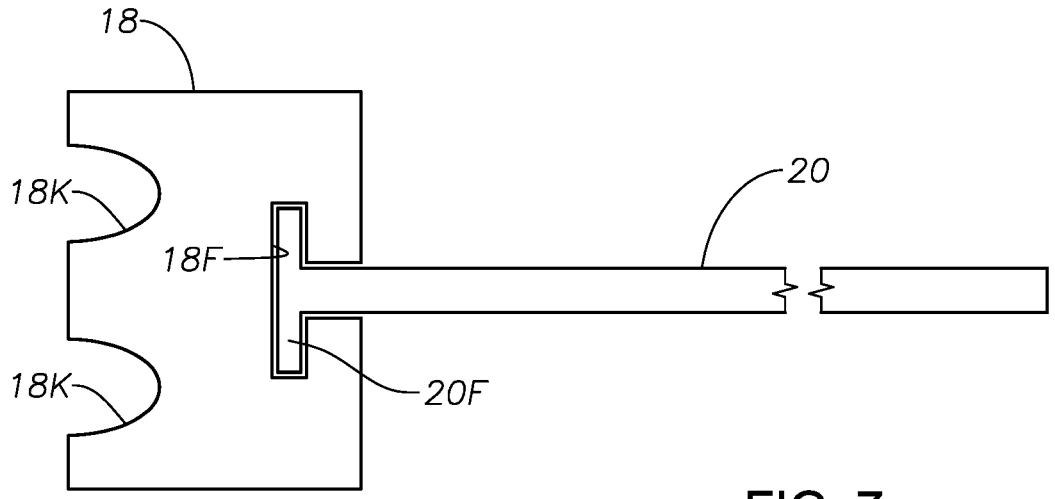
FIG. 7 shows a cross-section side view of another embodiment of a piston and gate.

FIG. 7 depicts a T-slot junction. The piston 18 has a "T" slot 18F configured through the piston body to accept the gate 20, which is formed with a corresponding "T" shaped end 20F. The gate 20 is slid into position in the T-slot 18F. FIG. 7 also depicts the piston with a pair of negative space sections 18K formed on the face opposite the gate junction. One or more negative space sections 18K can be formed and spaced across the surface of the piston body. These voids can vary in depth, position, and orientation (e.g. circular, oval, elongated, etc.).

Figure 8:
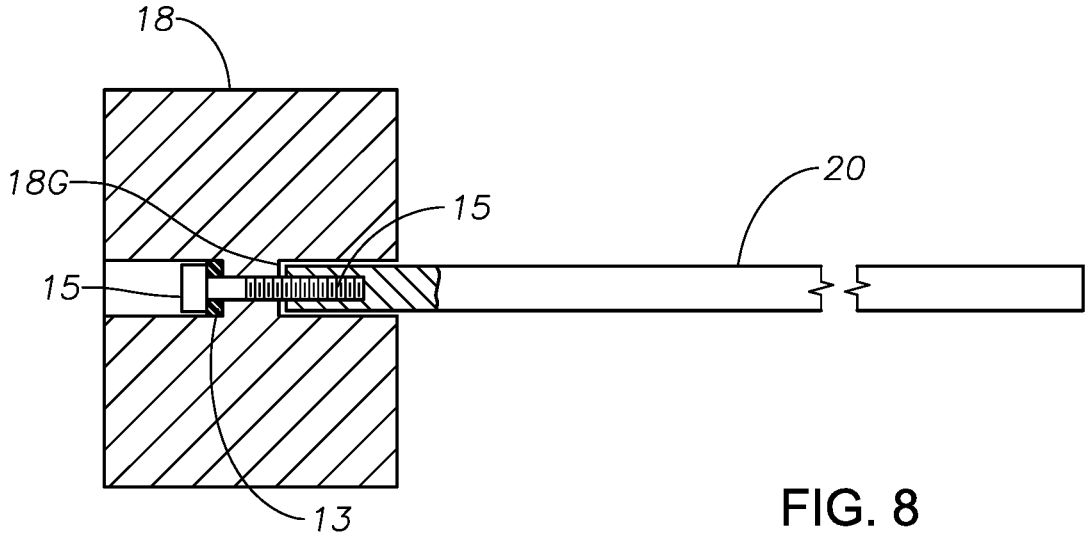
FIG. 8 shows a cross-section side view of another embodiment of a piston and gate.

FIG. 8 depicts a fastened gate embodiment. The piston 18 includes one or more holes 18G passing through the piston body to accept one or more bolts 15 passing through the piston body for engagement with matching threads formed on the gate 20 end. The assembly can be configured using only one bolt or multiple bolts disposed beside each other across the width of the gate 20. A seal 13 (e.g., O-ring) may also be included on each bolt 15. A possible advantage of the embodiment in FIG. 8 is the ability to provide a compressive preload to the piston-gate junction.

Figure 9:
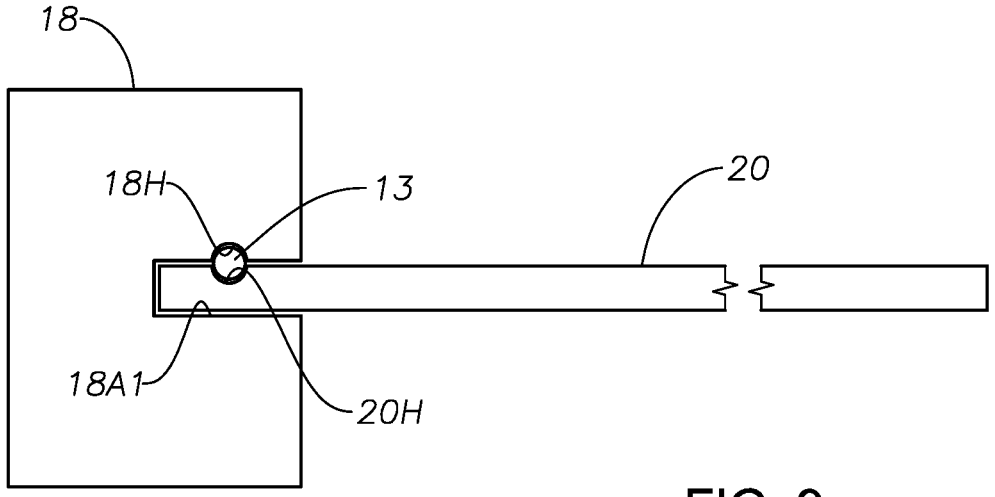
FIG. 9 shows a cross-section side view of another embodiment of a piston and gate.

FIG. 9 depicts an insert locking connection. The piston 18 is configured with a slot 18A1 to accept the gate 20. The slot 18A1 is further configured with an inner side surface having a void or recess 18H formed thereon extending into the piston body. The gate 20 is configured with a corresponding void or recess 20H formed on its surface to align and match with the void or recess 18H in the piston slot 18A1 when the gate 20 is engaged in the slot 18A1. When the gate 20 is seated in the piston slot 18A1, a key 13 or similar locking member is inserted into the orifice formed by the void/recess pair (18H, 20H) of the piston 18 and gate 20. The respective void/recesses on the piston 18 and gate 20 may be formed in any of various shapes such that when the gate 20 is engaged in the slot 18A1 the resulting orifice forms a specific configuration (e.g., a circle to accept pin or ball bearing, a diamond to accept a diamond-shaped key, a half-moon to accept such a key, etc.). The voids/recesses 18H, 20H may be formed to extend across the entire width of the piston 18 and the gate 20, respectively. Some embodiments may be configured with the void/recesses extending only partially across the width of the piston and gate. Other embodiments may be configured with voids/recesses formed on both inner side surfaces of the slot, with corresponding voids/recesses formed on the opposite surfaces of the gate.

Figure 10:
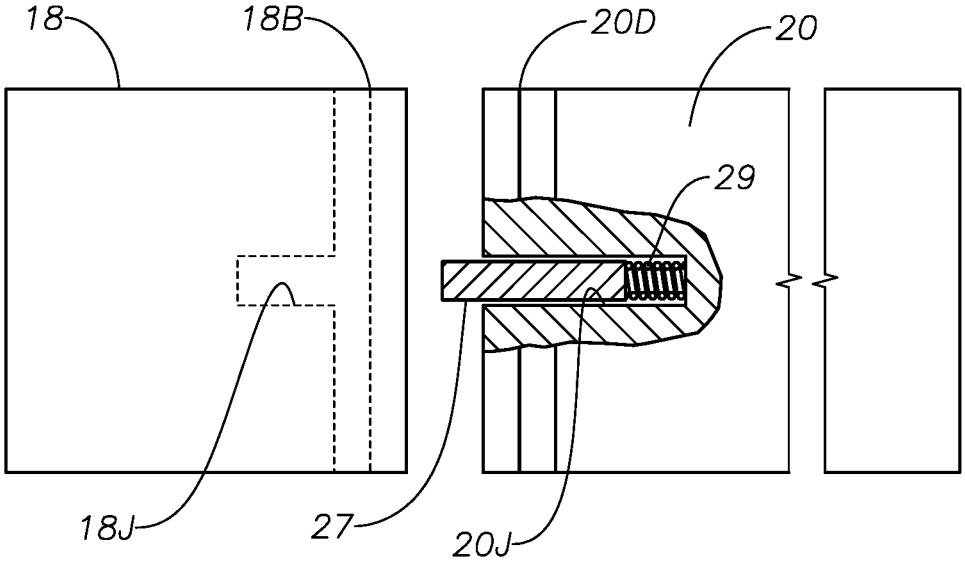
FIG. 10 shows an-overhead view of another embodiment.
Figure 11:
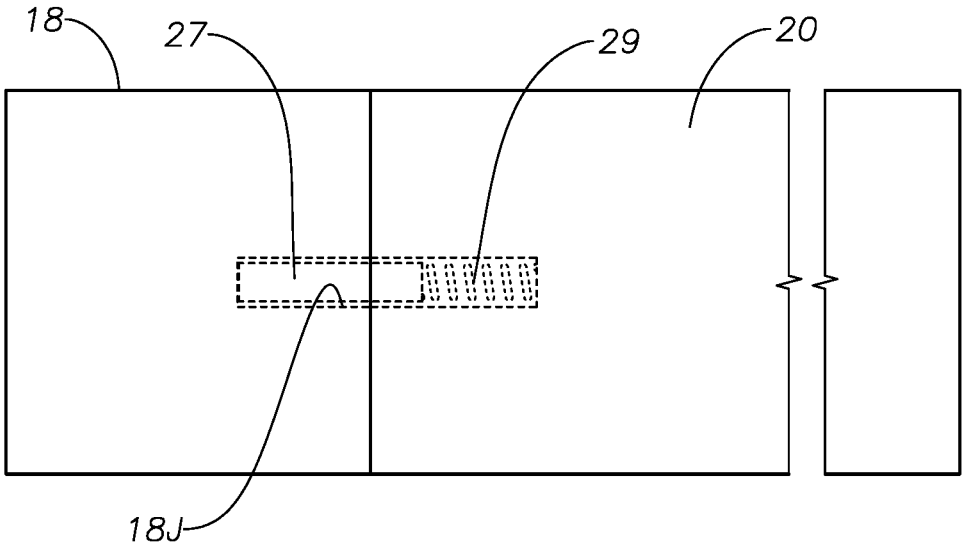
FIG. 11 shows an overhead view of the embodiment of FIG. 10 in the coupled position.

FIG. 10 depicts a spring-loaded detent gate locking structure. The embodiment in FIG. 10 may implement the splined designs as depicted in FIG. 3. However, the embodiment of FIG. 10 does not use the end plates of FIG. 3. A spring-loaded 29 dowel or pin 27 is inserted into a hole 20J formed at the end face of the gate 20. The piston 20 is configured with a hole 18J in the slot face, configured to align with the hole-dowel 20J/27 in the gate 20 when the gate 20 is coupled to the piston 18. As the gate 20 is slid into position on the piston 18, the spring 29 pushes the dowel 27 into engagement with the hole 18J in the piston 18 when the gate 20 is centralized into place. FIG. 11 depicts the gate 20 coupled to the piston 18 with the dowel 27 engaged to maintain the gate centralized and secured on the piston 18. The embodiments of FIGS. 4, 7 and 9 may also be configured with the spring-loaded dowel mechanism.

Any of the embodiments may be configured with negative space sections 18K formed in the piston body, as depicted in FIG. 7. The embodiments may be formed of any suitable materials using conventional components and hardware as known in the art. Irrespective of the manner in which the gate is coupled to the piston, such coupling should be sufficiently strong to transfer the kinetic energy in the gate through the piston to the energy absorbing element.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A ram for a blowout preventer, comprising:

a pressure chamber having a piston movably disposed therein;

a charge disposed at one end of the pressure chamber;

a one-piece planar gate coupled to the piston on a side of the piston opposed to the charge, the gate arranged to move across a through bore in a blowout preventer housing disposed at an opposed end of the pressure chamber, wherein the coupling comprises a tongue and groove coupling, the tongue defined by an end of the planar gate having a locking feature and the groove defined by a slot on the piston having a mating locking feature; wherein the tongue locking feature consists of splines and the groove locking feature consists of mating splines in one face of the piston; wherein the gate is configured to move along a passage transverse to the through bore; and wherein the coupling between the piston and the gate is configured to transfer deceleration of the piston to the gate.

2. The ram of claim 1 further comprising a locator dowel and a spring disposed in one face of the longitudinal end of the gate and a correspondingly located hole in the slot.

3. The ram of claim 1 wherein the gate comprises a smaller thickness at an end disposed in a slot in the piston than a thickness of a remainder of the gate.

4. The ram of claim 1 wherein the gate comprises a section intermediate the piston and a longitudinal end of the gate opposed to the piston having a thickness greater than a thickness of the gate at the opposed longitudinal end.

5. The ram of claim 1 wherein the piston comprises a negative space on a face opposed to the gate.

6. The ram of claim 1 wherein an energy absorbing element is disposed in the pressure chamber at an end of the pressure chamber opposed to the charge, the energy absorbing element arranged to decelerate the piston upon contact with the energy absorbing element.

7. A method for closing a through bore in a blowout preventer housing, comprising:

actuating a pyrotechnic charge;

applying gas pressure from the actuated charge to a movable piston;

transferring force generated by the gas pressure applied to the piston to a one-piece planar gate to generate kinetic energy wherein the planar gate is coupled to the piston via a tongue and groove coupling, the tongue defined by an end of the planar gate having a locking feature and the groove defined by a slot on the piston having a mating locking feature; wherein the tongue locking feature consists of splines and the groove locking feature consists of mating splines in one face of the piston; moving the gate across the through bore along a passage transverse to the through bore;

decelerating the piston proximate the through bore; and transferring deceleration of the piston to the gate.

8. The method of claim 7 wherein the piston comprises a negative space on a face opposed to the gate.

9. The method of claim 7 further comprising transferring energy from the piston to an energy absorbing element disposed in a path of the movable piston.

10. A blowout preventer, comprising:

a housing having a through bore;

the housing having a passage transverse to the thorough bore;

a pressure chamber having a piston movably disposed therein;

a charge disposed at one end of the pressure chamber;

a one-piece planar gate coupled to the piston and configured to move along the passage and across the through bore in response to activation of the charge, wherein the coupling comprises a tongue and groove coupling, the tongue defined by an end of the planar gate having a locking feature and the groove defined by a slot on the piston having a mating locking feature; wherein the tongue locking feature consists of splines and the groove locking feature consists of mating splines in one face of the piston; and wherein the coupling between the piston and the gate is configured to transfer deceleration of the piston to the gate.

11. The blowout preventer of claim 10 further comprising an energy absorbing element configured to decelerate the piston upon contact with the energy absorbing element.

12. The blowout preventer of claim 10 wherein the piston comprises a negative space on a face opposed to the gate.

* * * * *